US006955056B1

(12) United States Patent
An et al.

(10) Patent No.: US 6,955,056 B1
(45) Date of Patent: Oct. 18, 2005

(54) REFRIGERATOR AND CONTROL METHOD THEREOF

(75) Inventors: Hye Kyoung An, Pusan (KR); Sinn Bong Yoon, Gwangju (KR); Tae Wan Kang, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 6 days.

(21) Appl. No.: 10/814,791

(22) Filed: Apr. 1, 2004

(30) Foreign Application Priority Data

Mar. 30, 2004 (KR) ..... 10-2004-0021493

(51) Int. Cl.[7] ..... F25C 1/12
(52) U.S. Cl. ..... 62/74; 62/347; 62/426
(58) Field of Search ..... 62/66–74, 135–139, 62/340–356, 414, 419, 426

(56) References Cited

U.S. PATENT DOCUMENTS 3,025,679 A * 3/1962 Keighley ..... 62/71
3,350,899 A * 11/1967 Jones et al. ..... 62/414
4,852,359 A * 8/1989 Manzotti ..... 62/68
6,438,988 B1 * 8/2002 Paskey ..... 62/353

FOREIGN PATENT DOCUMENTS

CA 2 273 313 5/1999

* cited by examiner

*Primary Examiner*—William E. Tapolcai
(74) *Attorney, Agent, or Firm*—Staas & Halsey LLP

(57) ABSTRACT

A refrigerator for preventing the generation of frost and a control method of the refrigerator. The refrigerator includes an ice cube tray, a water supply unit for supplying water for making ice cubes to the ice cube tray, an air blast unit for circulating cooled air, and a controller for preventing the operation of the air blast unit in a water supply mode, in which the water is supplied to the ice cube tray.

10 Claims, 4 Drawing Sheets

REFRIGERATOR AND CONTROL METHOD THEREOF

CROSS-REFERENCE TO RELATED APPLICATION

This application claims the benefit of Korean Patent Application No. 2004-21493, filed Mar. 30, 2004, in the Korean Intellectual Property Office, the disclosure of which is incorporated herein by reference.

BACKGROUND OF THE INVENTION

1. Field of the Invention

The present invention relates to a refrigerator and a control method thereof, and, more particularly, to a refrigerator for preventing the generation of frost and a control method thereof.

2. Description of the Related Art

Generally, a refrigerator comprises freezing and refrigerating chambers for storing foods, a heat exchanger for heat-exchanging a refrigerant compressed by a compressor and condensed by a condenser with air in the refrigerator, and an air blast fan for circulating the air, in the refrigerator, cooled by the heat-exchanging into the freezing and refrigerating chambers.

The refrigerator serves to make ice cubes as well as to store foods at a low temperature. Conventionally, in order to obtain ice cubes, a user must fill an ice cube tray with water, put the ice cube tray into the freezing chamber, and then wait for a considerably long period of time. Therefore, the above conventional refrigerator causes a difficulty in using ice cubes when they are required, thus causing inconvenience to users.

In order to solve the above problem, a refrigerator provided with an ice-making device in a freezing chamber so as to automatically make ice cubes has been developed. Korean Registration Utility Model Publication No. 10-0152136 discloses the refrigerator provided with the ice-making device in detail. The conventional refrigerator provided with the ice-making device comprises an ice cube tray positioned in the freezing chamber, a water supply unit for supplying water to the ice cube tray, an ice cube storage container for storing obtained ice cubes before a user picks up the ice cubes, and a freezing chamber fan for supplying cold air to the ice cube tray. In order to make the ice cubes in the above refrigerator, the water is supplied to the ice cube tray, and the freezing chamber fan is operated to supply cold air to the ice cube tray.

However, since the freezing chamber fan of the above conventional refrigerator is operated to supply the cold air to the ice cube tray even when the water is supplied to the ice cube tray, vapor generated by evaporation of the water contacts the cold air, thus creating frost in the freezing chamber or conglomerating the ice cubes stored in the ice cube storage container.

That is, since the temperature of the water supplied to the ice cube tray in the summer is approximately 23° C., a small quantity of the water has supplied to the ice cube tray evaporates into vapor, and the vapor contacts the cold air circulated by the freezing chamber fan and then creates frost in the freezing chamber or conglomerates the ice cubes stored in the ice cube storage container into a lump, thereby causing a difficulty of efficiently discharging the ice cubes to the outside of the freezing chamber.

SUMMARY OF THE INVENTION

Therefore, an aspect of the invention is to provide a refrigerator for preventing the generation of frost and a control method thereof.

In accordance with one aspect, the present invention provides a refrigerator comprising: an ice cube tray; a water supply unit for supplying water for making ice cubes to the ice cube tray; an air blast unit for circulating cooled air; and a controller for preventing the operation of the air blast unit in a water supply mode, in which the water is supplied to the ice cube tray.

The water supply mode may include a water supply stage, in which the water is supplied to the ice cube tray, and a standby stage, in which the water is held in the ice cube tray for a designated time after the water supply is completed so that the temperature of the supplied water is lowered to a designated temperature.

The controller may determine whether or not the air blast unit is on at a point of time of starting the water supply, and turn off the air blast unit in case that it is determined that the air blast unit is on.

The controller may determine whether or not the water supply is completed after the air blast unit is turned off, and leave the air blast unit of at the standby stage in case that it is determined that the water supply is completed.

The controller may determine whether or not the water supply is completed in the water supply mode, determine whether or not the air blast unit is on in case that it is determined that the water supply is completed, turn off the air blast unit in case that it is determined that the air blast unit is on, and leave the air blast unit off in the standby stage.

In accordance with another aspect, the present invention provides a refrigerator comprising: a freezing chamber; an ice cube tray positioned in the freezing chamber; a water supply unit for supplying water for making ice cubes to the ice cube tray; an air blast unit for circulating air cooled by a heat exchanger to supply the cooled air to the ice cube tray; and a controller for preventing the operation of the air blast unit so that vapor generated from the water supplied to the ice cube tray by the cooled air supplied from the air blast unit is not frozen.

The controller may prevent the air blast unit from being operated in a water supply mode, in which the water is supplied to the ice cube tray.

In accordance with yet another aspect, the present invention provides a control method of a refrigerator having an ice cube tray, a water supply unit for supplying water for making ice cubes to the ice cube tray, and an air blast unit for supplying air cooled by a heat exchanger to the ice cube tray, comprising the steps of: (a) determining whether or not the refrigerator is operated in an ice-making mode; (b) in case that it is determined that the refrigerator is operated in the ice-making mode, determining whether or not the refrigerator is in a water supply mode, in which the water is supplied to the ice cube tray; (c) in case that it is determined that the refrigerator is in the water supply mode, determining whether or not the air blast unit is on; and (d) in case that it is determined that the air blast unit is on, turning off the air blast unit.

The control method may further comprise the steps of: (e) determining whether or not the water supply is completed after the air blast unit is turned off; and (f) in case that it is determined that the water supply is completed, leaving the air blast unit off for a designated time after the water supply is completed.

The control method may further comprise the step of (g) measuring the temperature of the freezing chamber after the designated time elapses, and determining whether or not the air blast unit is operated based on the measured temperature of the freezing chamber.

BRIEF DESCRIPTION OF THE DRAWINGS

The above objects, and other features and advantages of the present invention will become more apparent after reading the following detailed description when taken in conjunction with the drawings, in which.

DETAILED DESCRIPTION OF THE PREFERRED EMBODIMENTS

Figure 1:
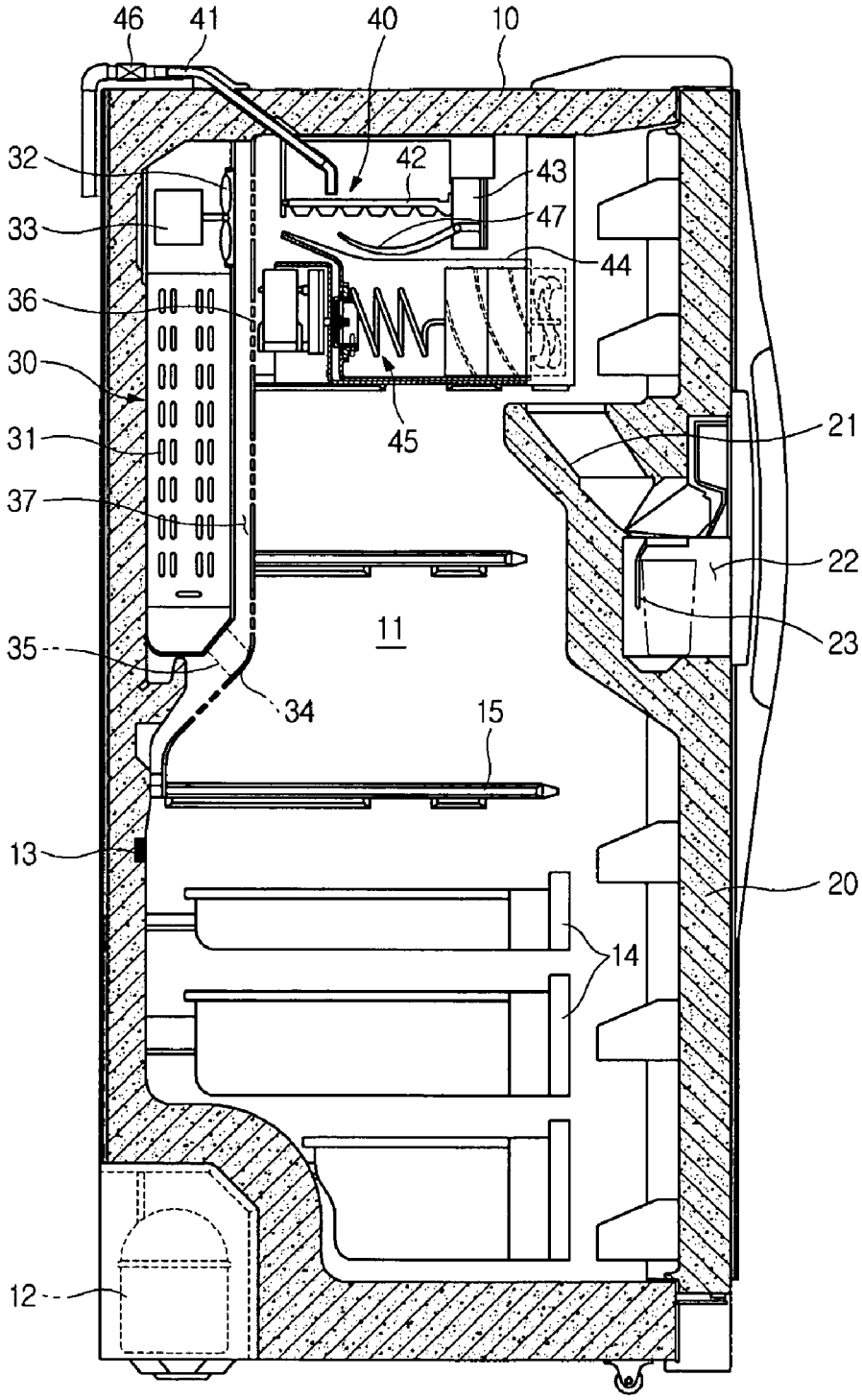
FIG. 1 is a longitudinal-sectional view of a refrigerator in accordance with an embodiment of the present invention.

Now, a preferred embodiment of the present invention will be described in detail with reference to the annexed drawings. As shown in FIG. 1, the refrigerator in accordance with an embodiment of the present invention comprises a freezing chamber 11 disposed in a main body 10 in a lengthwise direction and provided with an opened front surface, a freezing chamber door 20 positioned at the opened front surface for opening and closing the freezing chamber 11, and a compressor 12 installed at a lower part of a rear surface of the main body 10 for compressing a refrigerant. Further, a plurality of racks 15 and storage boxes 14 for storing foods are aligned in the freezing chamber 11.

A heat exchanging unit 30 for achieving the heat-exchange is installed between the rear surface of an upper part of the freezing chamber 11 and the main body 10, an ice-making unit 40 for automatically making ice cubes is installed at the upper part of the freezing chamber 11, and a freezing chamber temperature sensor 13 for sensing the temperature of the freezing chamber 11 is installed at a designated position of the rear surface of the freezing chamber 11.

The heat exchanging unit 30 includes a heat exchanger 31 for cooling air in the freezing chamber 11 by means of heat-exchanging, a freezing chamber fan 32 installed above the freezing chamber heat exchanger 31 for circulating the cooled air having passed through the freezing chamber heat exchanger 31 into the freezing chamber 11, and a fan motor 33 for operating the freezing chamber fan 32. An inlet 34, for allowing air in the refrigerator to be drawn into the freezing chamber heat exchanger 31 therethrough by the operation of the freezing chamber fan 32, and an intake path 35, for guiding the air drawn through the inlet 34 to the heat exchanger 31, are formed through the rear surface of the freezing chamber 11 below the freezing chamber heat exchanger 31. A plurality of outlets 36 for uniformly discharging cooled air blown by the freezing chamber fan 32 into the freezing chamber 11 are formed through the rear surface of the freezing chamber 11, and a discharge path 37 for guiding the cooled air blown by the freezing chamber fan 32 to the outlets 36 is formed between the heat exchanger 31 and the rear surface of the freezing chamber 11. Therefore, in case that the freezing chamber fan 32 is operated, the air in the freezing chamber 11 is drawn through the inlet 34 and the intake path 35, rises, and passes through the heat exchanger 31. Then, the air, which is cooled by the heat-exchange action of the heat exchanger 31, is guided by the discharge path 37 and is uniformly discharged into the freezing chamber 11 through the outlets 36.

The ice-making unit 40 includes a water supply pipe 41 for supplying water for making ice cubes, an ice cube tray 42 for storing the water supplied from the water supply pipe 41 and making ice cubes from the water, an ice cube tray operator 43 for rotating the ice cube tray 42 for removing the ice cubes from the ice cube tray 42, and a full ice level lever 47 installed at a side portion of the ice cube tray operator 43 for sensing the quantity of the ice cubes stored in an ice storage container 44, which will be described later. The ice storage container 44, for storing the ice cubes removed from the ice cube tray 42, and a transferring unit 45, for automatically transferring the ice cubes stored by the ice storage container 44 to the outside of the freezing chamber 11, are installed below the ice cube tray 42.

The water supply pipe 41 is provided with one end extended toward the upper part of the ice cube tray 42 so that the water is stably supplied from the water supply pipe 41 to the ice cube tray 42, and a water supply valve 46 for regulating the flow of the water supplied to the ice cube tray 42 is installed at a designated position of the water supply pipe 41.

A discharge guide pipe 21, communicating with the inside of the freezing chamber 11 for guiding the discharge of the ice cubes so that the ice cubes stored by the ice storage container 44 are drawn out without a user having to open the freezing chamber door 20, is installed in the freezing chamber door 20, and an ice receiving space 22 for receiving the ice cubes discharged through the discharge guide pipe 21 is indented in the front surface of the freezing chamber door 20. A switch 23 for opening and closing an outlet of the discharge guide pipe 21 and operating the transferring unit 45 is installed in the ice receiving space 22.

Figure 2:
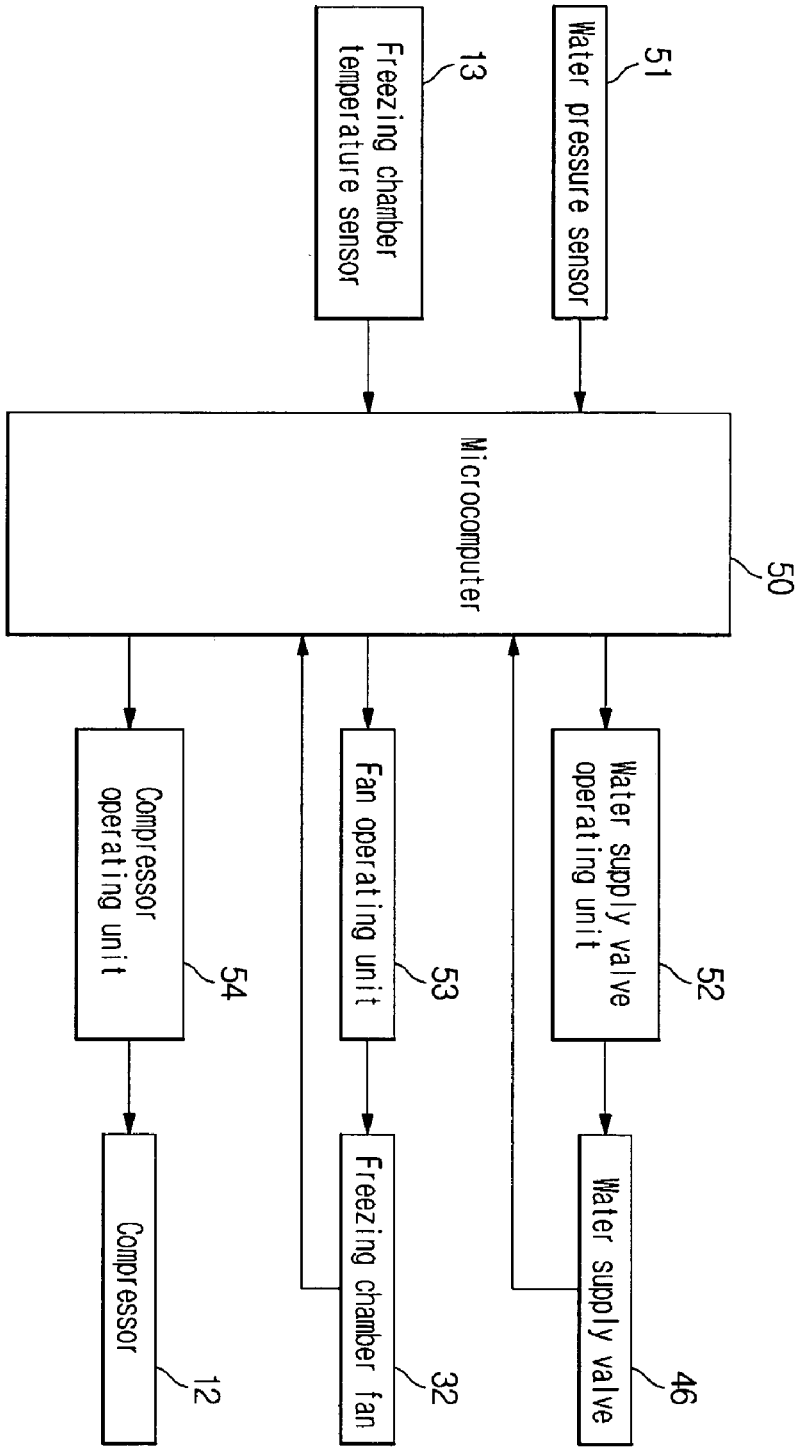
FIG. 2 is a block diagram illustrating constitution of the refrigerator shown in FIG. 1.

As shown in FIG. 2, the refrigerator in accordance with the embodiment of the present invention further comprises a water pressure sensor 51 for sensing the pressure of the supplied water, a water supply valve operating unit 52 for operating the water supply valve 46, a fan operating unit 53 for operating the freezing chamber fan 32, a compressor operating unit 54 for operating the compressor 12, and a microcomputer 50 for controlling the overall operation of the refrigerator.

Figure 3:
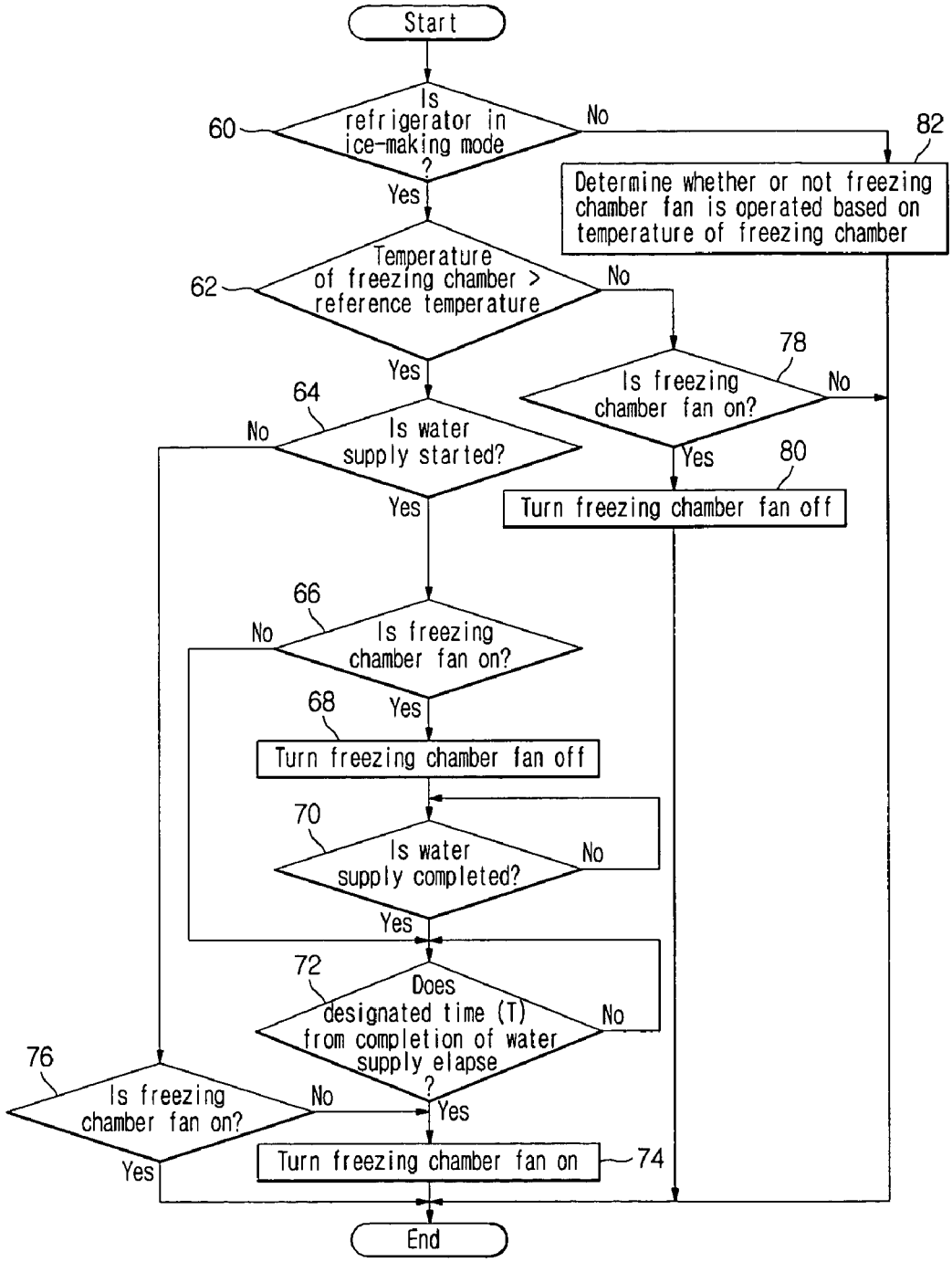
FIG. 3 is a flow chart illustrating operation of the refrigerator shown in FIG. 2.

Hereinafter, with reference to FIG. 3, operation of the refrigerator shown in FIG. 2 will be described in detail. The generation of frost due to the contact of the water supplied to the freezing chamber 11 with vapor obtained by evaporation of the water is mainly caused in an ice-making mode, in which ice cubes are made by the ice-making unit 40. First, the microcomputer 50 determines whether or not the refrigerator is in the ice-making mode (S60).

In case that it is determined that the refrigerator is in the ice-making mode, the microcomputer 50 receives a temperature of the freezing chamber 11 measured by the freezing chamber temperature sensor 13 and determines whether or not the temperature of the freezing chamber 11 is higher than a reference temperature (S62). The reference temperature denotes a temperature used as an index for operating the freezing chamber fan 32. In case that the temperature of the freezing chamber 11 is higher than the reference temperature, the microcomputer 50 operates the freezing chamber fan 32, and in case that the temperature of the freezing chamber 11 is lower than the reference temperature, the microcomputer 50 turns off the freezing chamber fan 32.

The reference temperature is set by the temperature of the freezing chamber 11 selected by a user using a temperature regulator (not shown) of the refrigerator. For example, in case that a refrigerating capacity of the refrigerator is regulated in three stages, such as high, medium and low levels, so that a target control temperature of the freezing chamber 11, when the high level of the refrigerating capacity is selected, is "−20° C.", the target control temperature of the freezing chamber 11, when the medium level of the refrigerating capacity is selected, is "−15° C.", and the target control temperature of the freeing chamber 11, when the low level of the refrigerating capacity is selected, is "−10° C.". When the user selects the high level of the refrigerating capacity through the temperature regulator of the refrigerator, the reference temperature is set to "−20° C.".

Differently from the above case, the reference temperature may be selected according to modes of the refrigerator. That is, the target control temperature of the freezing chamber 11 in a freezing mode of the refrigerator may be set differently from the target control temperature of the freezing chamber 11 in the ice-making mode of the refrigerator. When the refrigerator is operated in the ice-making mode, the predetermined target control temperature in the ice-making mode may be the reference temperature of the freezing chamber 11.

In case that the temperature of the freezing chamber 11 is higher than the reference temperature in step S62, the microcomputer 50 determines whether or not the water supply is started in a water supply mode (S64). In this embodiment of the present invention, the water supply mode includes a water supply stage, in which the water is supplied to the ice cube tray 42, and a standby stage, in which the water is held in the ice cube tray 42 for a designated time after the water supply is completed so that the temperature of the supplied water is lowered to a designated temperature. Whether or not the water supply is started in the water supply mode is determined by whether or not the water supply valve 46 is opened or whether the pressure of the water is sensed by the water pressure sensor 51.

In case that it is determined that the water supply is not started, the microcomputer 50 determines whether or not the freezing chamber fan 32 is on (S76). In case that it is determined that the freezing chamber fan 32 is on, the microcomputer 50 terminates the cycle of the refrigerator, and in case that it is determined that the freezing chamber fan 32 is off, the microcomputer 50 turns on the freezing chamber fan 32 to lower the temperature of the freezing chamber 11 (S74). Here, whether of not the compressor 12 is operated is controlled by a separate algorithm stored in the microcomputer 50. When the freezing chamber fan 32 is on, the cooled air blown by the freezing chamber fan 32 is supplied to the freezing chamber 11 through the outlet 36, thereby lowering the temperature of the freezing chamber 11.

In case that it is determined that the water supply is started, the microcomputer 50 determines whether or not the freezing camber fan 32 is on (S66). In case that it is determined that the freezing chamber fan 32 is on, the microcomputer 50 turns off the freezing chamber fan 32 so that the discharged cooled air does not contact the vapor obtained due to evaporation of the water, and in case that it is determined that the freezing chamber fan 32 is off, the microcomputer 50 performs step S72, which will be described later.

Thereafter, the microcomputer 50 determines whether or not the water supply is completed (S70). In case that it is determined that the water supply is not completed, the microcomputer 50 returns the refrigerating cycle to step S70, and in case that it is determined that the water supply is completed, the microcomputer 50 determines whether or not a designated time (T) from the completion of the water supply elapses (S72). In case that it is determined that the designated time (T) has not elapsed, the microcomputer 50 returns the refrigerating cycle to step S72, and in case that it is determined that the designated time (T) has elapsed, the microcomputer 50 presumes that the probability of the generation of frost is low and turns on the freezing chamber fan 32 (S74). The turning-on of the freezing chamber fan 32 after the designated time from the completion of the water supply leaves a time to be taken for allowing the temperature of the water to be lowered, and prevents the freezing chamber fan 32 from operating, thereby preventing the generation of frost and conglomeration of the obtained ice cubes. The designated time (T) taken to lower the temperature of the water after the completion of the water supply is set to a proper value by experimentation. Since the ice cubes are not conglomerated in the refrigerator of the embodiment of the present invention, the obtained ice cubes are easily transferred by the transferring unit 45.

On the other hand, in case that it is determined that the temperature of the freezing chamber 11 measured by the freezing chamber temperature sensor 13 in step S62 is lower than the reference temperature, the microcomputer 50 determines whether or not the freezing chamber fan 32 is on (S78). In case that it is determined that the freezing chamber fan 32 is on, the microcomputer 50 turns off the freezing chamber fan 32 (S80), and in case that it is determined that the freezing chamber fan 32 is off, the microcomputer 50 terminates the cycle.

Further, in case that it is determined that the refrigerator is not in the ice-making mode in step S60, the microcomputer 50 determines whether or not the freezing chamber fan 32 is operated according to the temperature of the freezing chamber 11 (S82). That is, in case that the temperature of the freezing chamber 11 is higher than the target control temperature, the microcomputer 50 turns on the freezing chamber fan 32, and in case that the temperature of the freezing chamber 11 is lower than the target control temperature, the microcomputer 50 turns off the freezing chamber fan 32.

Figure 4:
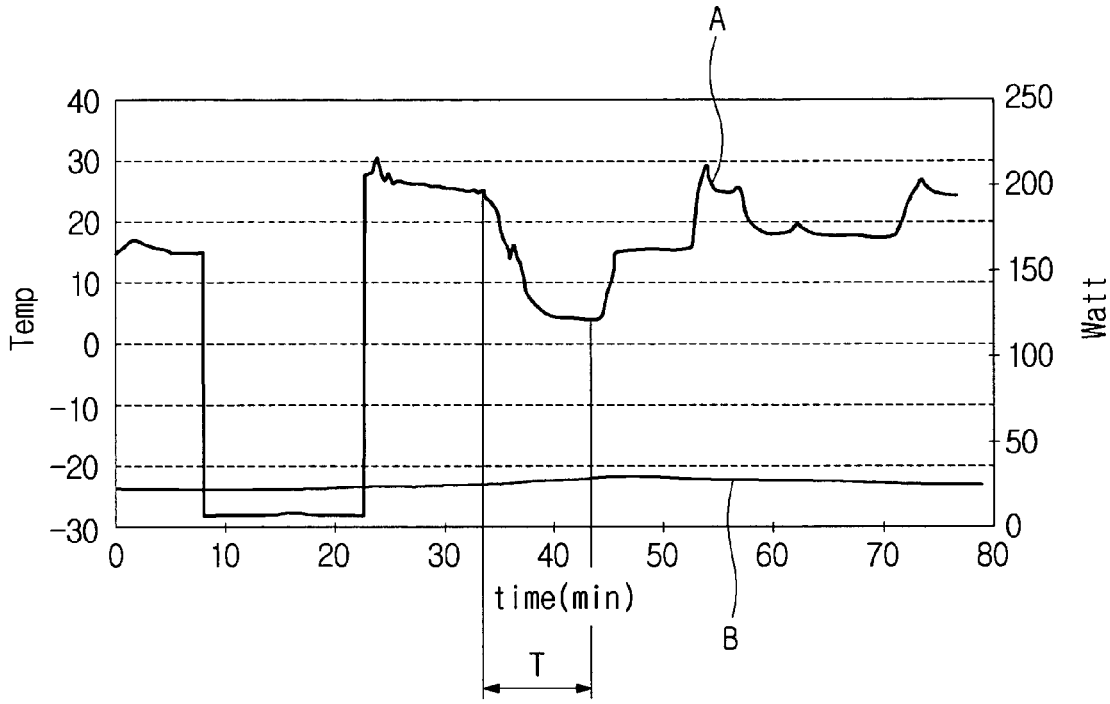
FIG. 4 is a graph illustrating the relation between supplied electricity and a temperature in a freezing chamber in the refrigerator shown in FIG. 2.

In FIG. 4, a curve A illustrates variation in supplied electricity of the refrigerator, and a curve B illustrates variation in temperature of the freezing chamber 11. As shown in FIG. 4, although the freezing chamber fan 32 is not operated during the designated time (T) from the completion of the water supply in the ice-making mode, the temperature of the freezing chamber 11 does not highly vary. Accordingly, the refrigerator of the present invention prevents the variation in the temperature of the freezing chamber 11 and the generation of frost in the freezing chamber 11.

In this embodiment of the present invention, in order to prevent the generation of frost in the freezing chamber 11, the freezing chamber fan 32, which is on, is turned off at a point of time of starting the water supply. However, a point of time of turning off the freezing chamber fan 32 is not limited to the point of time of starting the water supply.

The quantity of vapor generated from the completion of the water supply to a point of time of lowering the temperature of the water below a designated value may be substantially more than the quantity of vapor generated during the water supply into the ice cube tray. In case that it is determined that the freezing chamber fan 32 is on after the completion of the water supply, the freezing chamber fan 32, which is on, may be turned off.

As apparent from the above description, the present invention provides a refrigerator for preventing the generation of frost in a freezing chamber or the conglomeration of stored ice cubes, and a control method of the refrigerator.

Although the preferred embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

an ice cube tray;

a water supply unit for supplying water for making ice cubes to the ice cube tray;

an air blast unit for circulating cooled air; and a controller for preventing the operation of the air blast unit in a water supply mode, in which the water is supplied to the ice cube tray.

2. The refrigerator according to claim 1, wherein the water supply mode includes a water supply stage, in which the water is supplied to the ice cube tray, and a standby stage, in which the water is held in the ice cube tray for a designated time after the water supply is completed so that the temperature of the supplied water is lowered to a designated temperature.

3. The refrigerator according to claim 2, wherein the controller determines whether or not the air blast unit is on at a point of time of starting the water supply, and turns off the air blast unit in case that it is determined that the air blast unit is on.

4. The refrigerator according to claim 3, wherein the controller determines whether or not the water supply is completed after turning off of the air blast unit, and leaves the air blast unit off at the standby stage in case that it is determined that the water supply is completed.

5. The refrigerator according to claim 2, wherein the controller determines whether or not the water supply is completed in the water supply mode, determines whether or not the air blast unit is on in case that it is determined that the water supply is completed, turns off the air blast unit in case that it is determined that the air blast unit is on, and leaves the air blast unit off in the standby stage.

6. A refrigerator comprising:

a freezing chamber;

an ice cube tray positioned in the freezing chamber;

a water supply unit for supplying water for making ice cubes to the ice cube tray;

an air blast unit for circulating air cooled by a heat exchanger to supply the cooled air to the ice cube tray; and a controller for preventing the operation of the air blast unit so that vapor generated from the water supplied to the ice cube tray by the cooled air supplied from the air blast unit is not frozen.

7. The refrigerator according to claim 6, wherein the controller prevents the air blast unit from being operated in a water supply mode, in which the water is supplied to the ice cube tray.

8. A control method of a refrigerator having an ice cube tray, a water supply unit for supplying water for making ice cubes to the ice cube tray, and an air blast unit for supplying air cooled by a heat exchanger to the ice cube tray, comprising the steps of:

(a) determining whether or not the refrigerator is operated in an ice-making mode;

(b) in case that it is determined that the refrigerator is operated in the ice-making mode, determining whether or not the refrigerator is in a water supply mode, in which the water is supplied to the ice cube tray;

(c) in case that it is determined that the refrigerator is in the water supply mode, determining whether or not the air blast unit is on; and (d) in case that it is determined that the air blast unit is on, turning the air blast unit off.

9. The control method according to claim 8, further comprising the steps of:

(e) determining whether or not the water supply is completed after the air blast unit is turned off; and (f) in case that it is determined that the water supply is completed, leaving the air blast unit off for a designated time after the water supply is completed.

10. The control method according to claim 9, further comprising the step of (g) measuring the temperature of the freezing chamber after the designated time elapses, and determining whether or not the air blast unit is operated based on the measured temperature of the freezing chamber.

* * * * *